United States Patent [19]

Baus

[11] 4,274,400

[45] Jun. 23, 1981

[54] MASSAGE SHOWER HAVING A GUIDE RAIL

[76] Inventor: Heinz G. Baus, Ulmenweg 46, CH-3601 Thun, Switzerland

[21] Appl. No.: 98,349

[22] Filed: Nov. 29, 1979

[30] Foreign Application Priority Data

Dec. 2, 1978 [DE] Fed. Rep. of Germany ..... 2852265

[51] Int. Cl.[3] ..... A61H 7/00

[52] U.S. Cl. ..... 128/53; 128/65

[58] Field of Search ..... 128/65, 66, 53, 44

[56] References Cited

U.S. PATENT DOCUMENTS

| | | | |
|---|---|---|---|
| 2,068,757 | 1/1937 | Mishelle | 128/53 |
| 3,042,949 | 7/1962 | Mosely | 128/65 |
| 3,768,462 | 10/1973 | Boulard | 128/53 |

*Primary Examiner*—John D. Yasko

*Attorney, Agent, or Firm*—Herbert L. Lerner

[57] ABSTRACT

Massage shower with a substantially vertical guide rail including a massage head for delivering service water, the massage head being automatically displaceable upwardly and downwardly along the guide rail and fixable in a selective position thereon, and means driven and controlled by the service water for driving the massage head in longitudinal direction of the guide rail.

9 Claims, 11 Drawing Figures

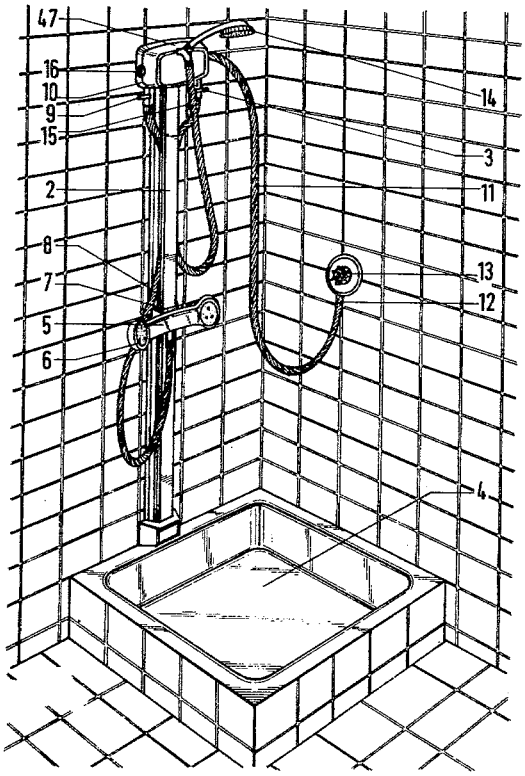

MASSAGE SHOWER HAVING A GUIDE RAIL

The invention relates to a massage shower having a substantially vertical guide rail along which a massage head is automatically displaceable upwardly and downwardly and fixable in a selective position, the massage head delivering service water.

Such a massage shower may find use in baths, hospitals and private households. In such applications, the requirement exists of also effecting a massage in addition to washing.

A shower head has become known heretofore from German Published Prosecuted Application DE-AS No. 2 615 872 which delivers water selectively in pulsating or steady flow and can serve for massaging. This heretofore known shower head contains a comminuting device for receiving all of the water entering the shower head, and an adjusting device for setting a steady or a pulsating flow. Starting therefrom, this shower head can be firmly clamped in a desired position in a conventional manner on a vertical guide rail i.e. on a guidance rod vertically mounted on the wall of the shower room. For this purpose, various holders are generally known. The shower head can also be removed from the holder and can be guided by hand to perform a large-area massage. A back massage or simultaneous washing and massaging are very difficult to perform. Likewise, this heretofore known device is not suited for the treatment of the ill who are limited in freedom of movement.

From German Published Non-Prosecuted Application DE-OS No. 26 50 517, a massage shower of the initially mentioned type has become known heretofore. In this massage shower movement of the massage head along the guide rail is effected by an electric drive. A disadvantage thereof is that electric lines are necessary. The installation of such a heretofore known massage shower requires the installation of electric lines as well, which are not desired in a shower room.

From German Petty Patent DE-GM No. 19 38 758, a massage and cleansing appliance has become known heretofore wherein the drive is provided by the medium used for the massage or for cleansing. In this heretofore known massage appliance, the head of the massage appliance is set into rotation. With this heretofore known massage appliance, the body or the surface to be cleansed is directly treated. A disadvantage thereof is that this known massage appliance must be guided by hand over the surface to be treated and no large surface automatic massage is possible.

It is an object of the invention to provide a massage shower having a guide rail which offers a large area automatic massage at relatively low expense.

It is a further object of the invention to provide such a massage shower which may be directly installed i.e. connected to the conventional service water connection in a bathroom so that, in addition to the installation thereof in new construction, it is also possible to substitute them for existing showers in old construction.

With the foregoing and other objects in view, there is provided, in accordance with the invention, a massage shower with a substantially vertical guide rail including a massage head for delivering service water, the massage head being automatically displaceable upwardly and downwardly along the guide rail and fixable in a selective position thereon, and means driven and controlled by the service water for driving the massage head in longitudinal direction of the guide rail.

The alternating downward displacement and upward displacement guides the massage head along the body of the showering person and permits a large-area massage automatically. Moreover, the construction according to the invention manages without any aids foreign to the system i.e. it requires no additional energy source for the drive, such as an electric motor, for example, which would require the installation of electric lines; the installation is facilitated and the operational reliability improved.

If the guide rail is constructed with two long vertical sections, and two short connecting pieces in a closed guidance, the shower head thus moves along the guidance alternatingly like a paternoster upwards and downwards, the change-over from the upwards movement to the downwards movement being effected automatically due to the connecting pieces of the guidance.

The massage shower is preferably constructed with a rectilinear guide rail, two adjustable stops limiting the movement of the massage head mounted on a slide carriage, and the drive mechanism is constructed as a reversing drive. With the exception of special uses in hospitals, these rectilinear guide rails are applied vertically to the wall of a room, extending conventionally to above the normal height of the body, so that with a suitable adjustment of the stops, an upwards and downwards movement is possible over any desired region of the body.

In accordance with another feature of the invention, the reversing drive comprises a turbine housing, a turbine wheel mounted for rotation in the turbine housing and means, including a slide valve, for selectively supplying service water in two tangential directions (lines) corresponding to opposite rotary directions of the turbine wheel.

In accordance with a further feature of the invention, a reduction gearing is connected to the turbine on a driven side thereof in order to achieve a torque adequate for the displacement of the slide carriage carrying the massage head.

In accordance with an added feature of the invention, the rotary motion of the transmission can be changed over into longitudinal displacement of the slide carriage, on the one hand, with locally fixed disposition of the turbine or, on the other hand, with movable disposition of the turbine.

In the initially mentioned embodiment of the invention for a locally fixed turbine, the turbine and the slide valve are disposed in a common, spatially or locally fixed structural unit disposed above or below on the guide rail, directly (or through a water hose) connectible to a service water connection of the building; this structural unit, further in accordance with the invention, has a connecting union for the discharging turbine water which is connected to the massage head through a flexible water hose having a length corresponding to the greatest distance of the slide carriage from the structural unit, and supplies the turbine water to the massage head.

In accordance with an additional feature of the invention with respect to the last mentioned embodiment, there is included a chain wheel and a chain disposed at the reduction gearing on the driven side, and a slide carriage slidably mounted on the guide rail, the chain being connected at one end thereof to an upper side of the slide carriage and at the other end around a deflecting roller to an underside of the slide carriage.

In accordance with yet another feature of the invention, the changeover of the drive in this case is effected by a displaceable change-over rod disposed axially parallel to the guide rail, respective stop members adjustably carried by the change-over rod above and below the slide carriage, the change-over rod being in engagement with the slide valve.

In accordance with yet a further feature of the invention and for reasons of stability and operational reliability, the guide rail is constructed as a hollow-chamber section formed with two laterally open slide guides and two lateral surfaces extending at an obtuse angle toward a side thereof by which the guide rail is connectible to a shower-room wall, and a slide carriage is included spanning the guide rail inclusive of the lateral surfaces, covering the laterally open slide guides, and formed with guide members guidingly engaging in the slide guides.

With this outwardly, largely closed shape, water and spraying soap foam cannot reach the guide elements directly.

In accordance with yet an added feature of the invention and to reduce friction between the slide guides, on the one hand, and the guide members, on the other hand, at least one of the slide guides, on the one hand, and the guide members, on the other hand, is formed with at least three guide ribs extending parallel to the guide rail and forming common contact locations therebetween.

In accordance with yet an additional feature of the invention, one of said guide members is of hollow construction, and including a displaceable change-over rod disposed axially parallel to the guide rail, said change-over rod being loosely surrounded by said one hollow guide member.

In accordance with another feature of the invention, there is provided a slide carriage wherein the turbine and the slide valve are located, gear means located at the reduction gearing on the driven side thereof, a toothed rack in the guide rail being in meshing engagement with said gear means, means for supplying water to the massage head, said water supplying means comprising a service water supply connection and a flexible water hose having a length greater than the greatest distance of the slide carriage from the service water supply connection, the flexible water hose connection, the massage head to the service water supply connection.

In accordance with a concomitant feature of the invention, employed with the last-mentioned embodiment, especially, the guide rail is in the form of a closed curve.

Other features which are considered as characteristic for the inventionare set forth in the appended claims.

Although the invention is illustrated and described herein as embodied in a massage shower with a guide rail, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 5:
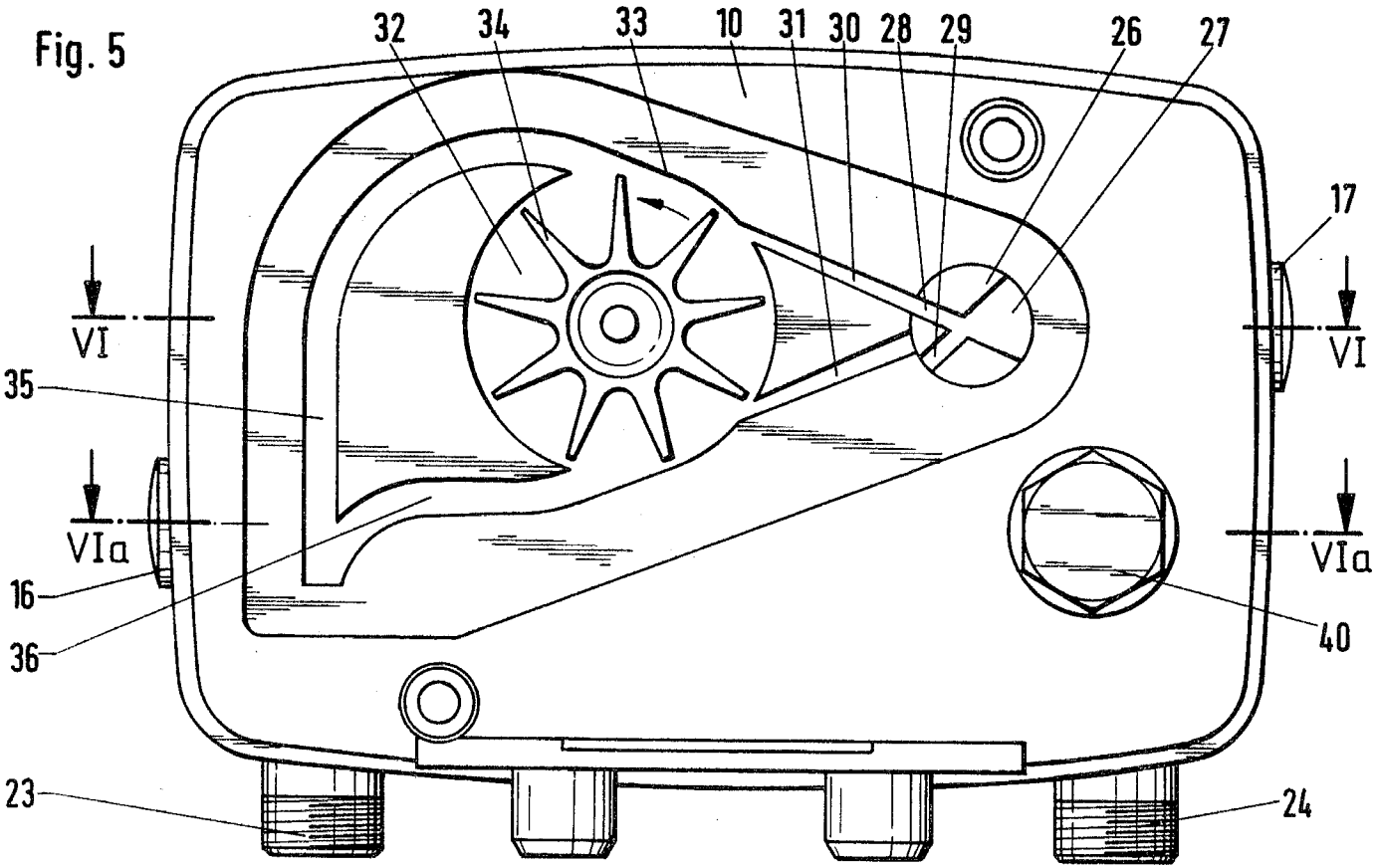
FIG. 5 is an enlarged fragmentary view of FIG. 4 showing a structural unit for the water connection having a turbine and a control or distributing slide valve, the parts located upstream of the turbine, in flow direction of the water, having been removed.
Figure 5A:
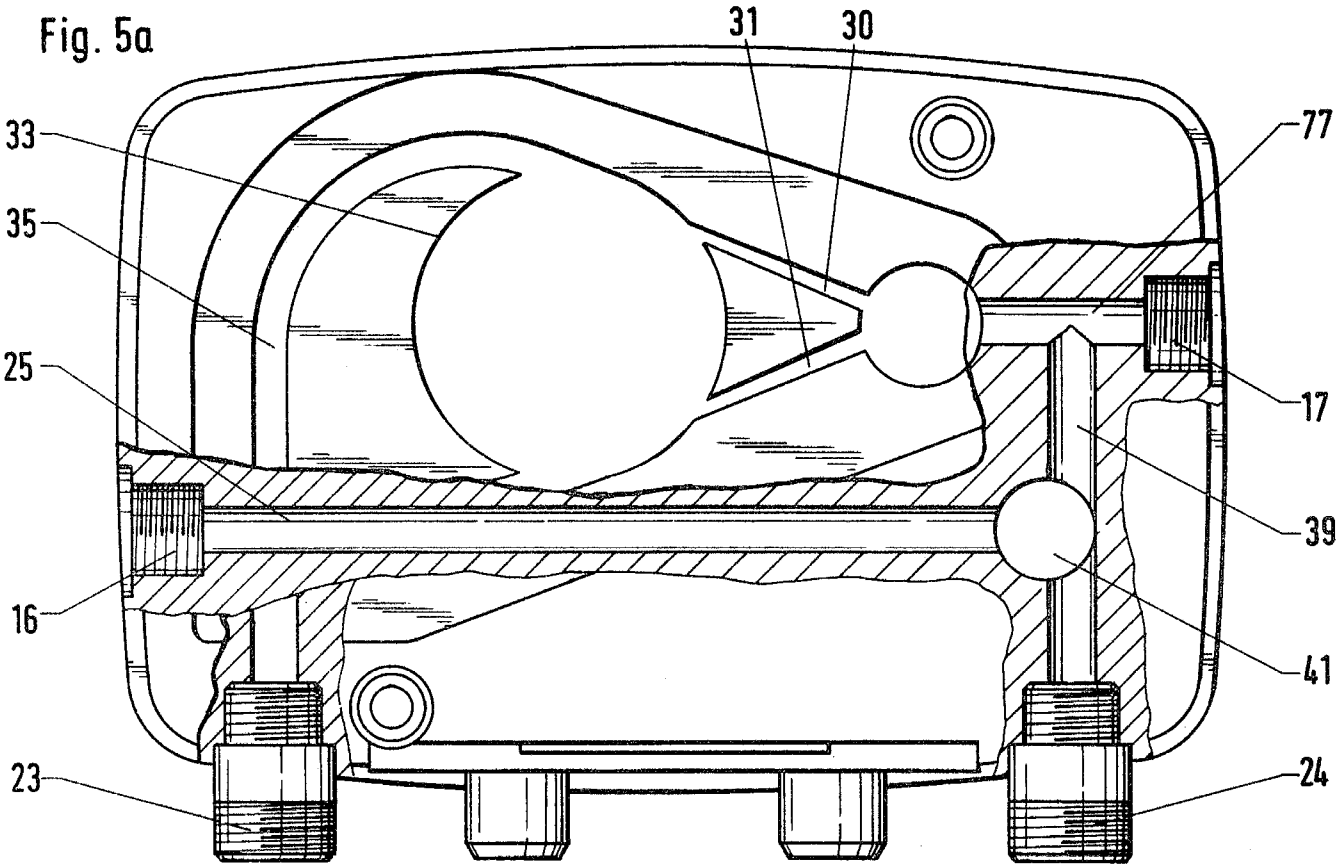
Figure 6:
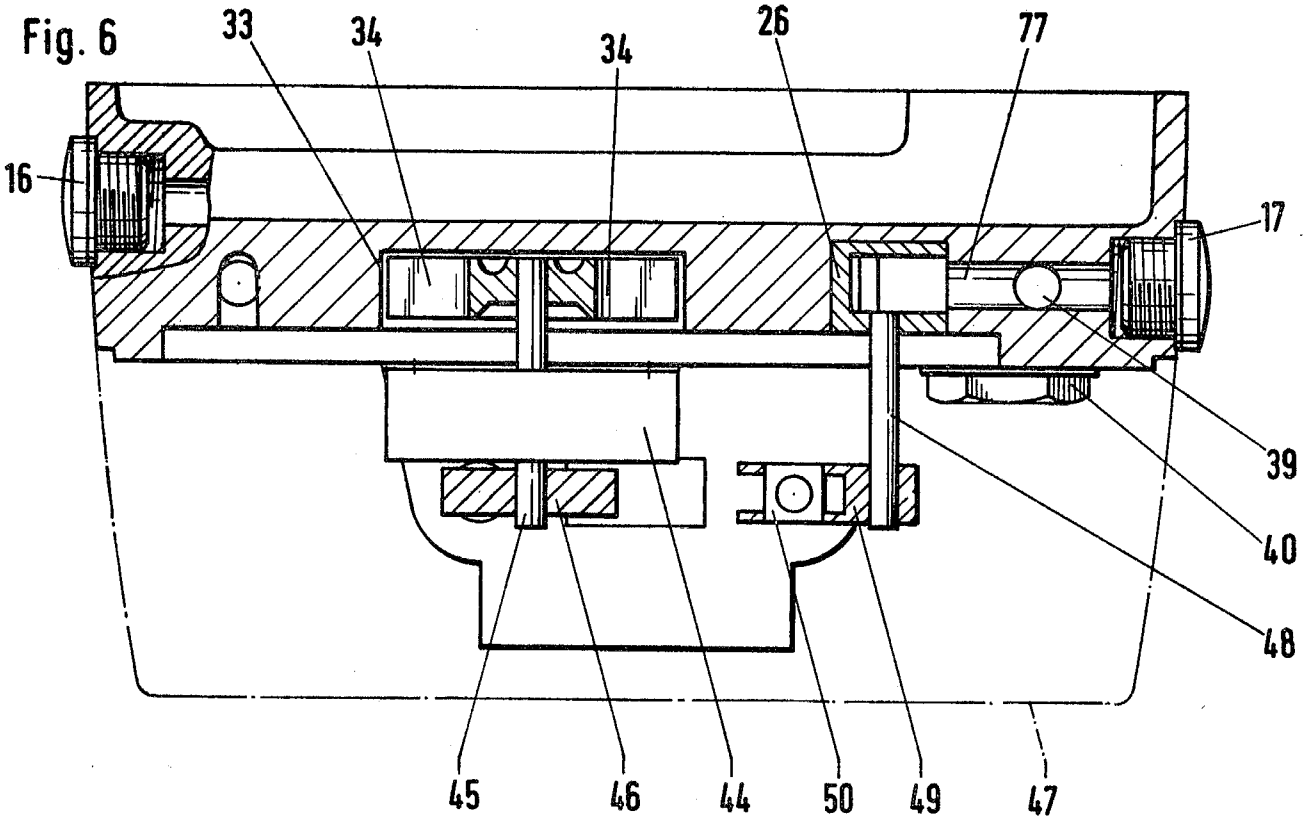

FIG. 5*a* is a view similar to that of FIG. 5 but partly broken away and in section to show the channel system;

FIG. 6 is a cross-sectional view of FIG. 5 taken along the line VI—VI in direction of the arrows.

Figure 2:
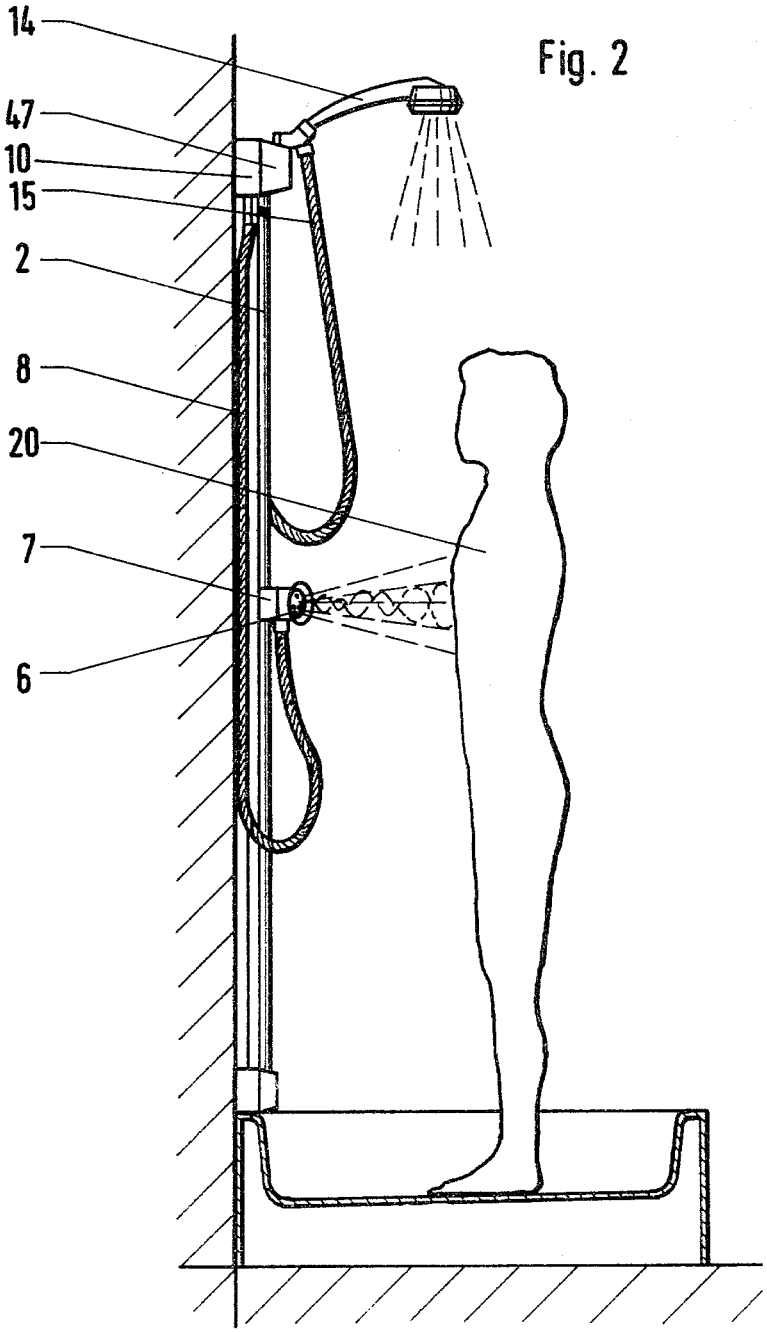
FIG. 2 is a side elevational view of FIG. 1.
Figure 6A:
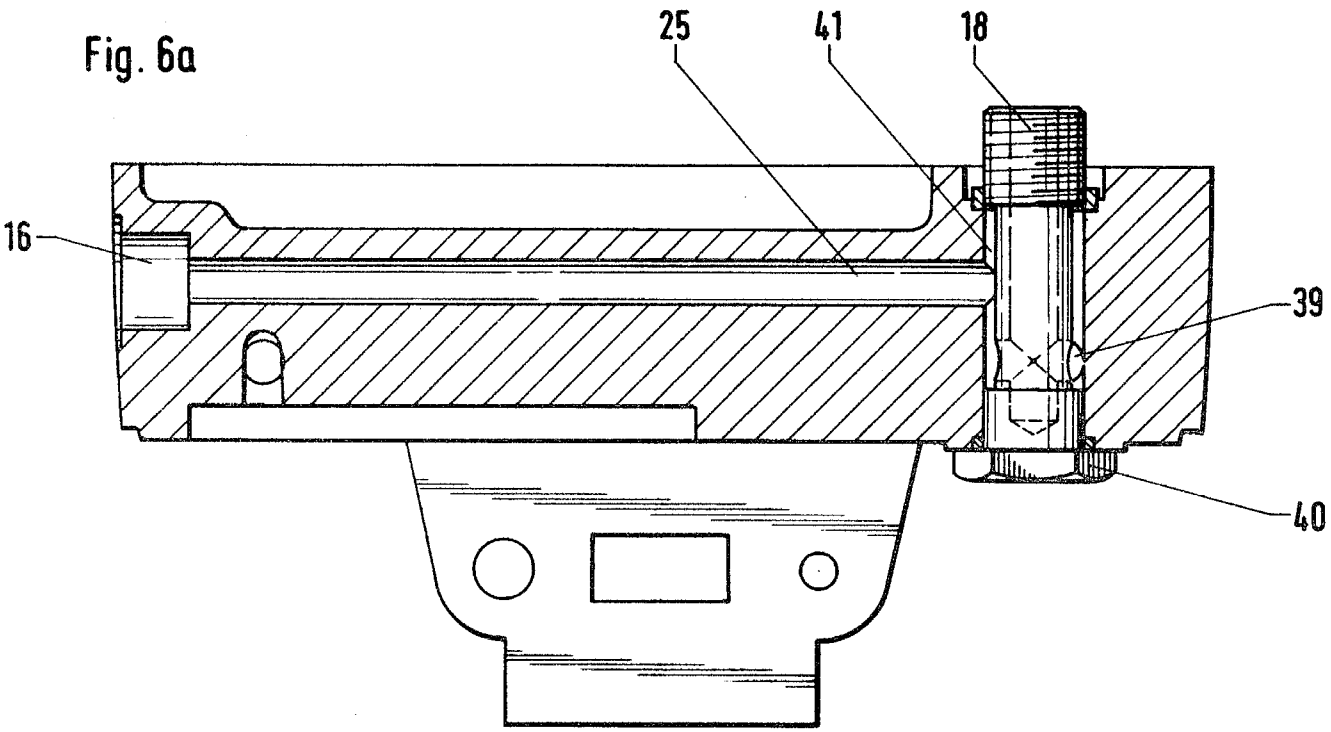
Figure 7:
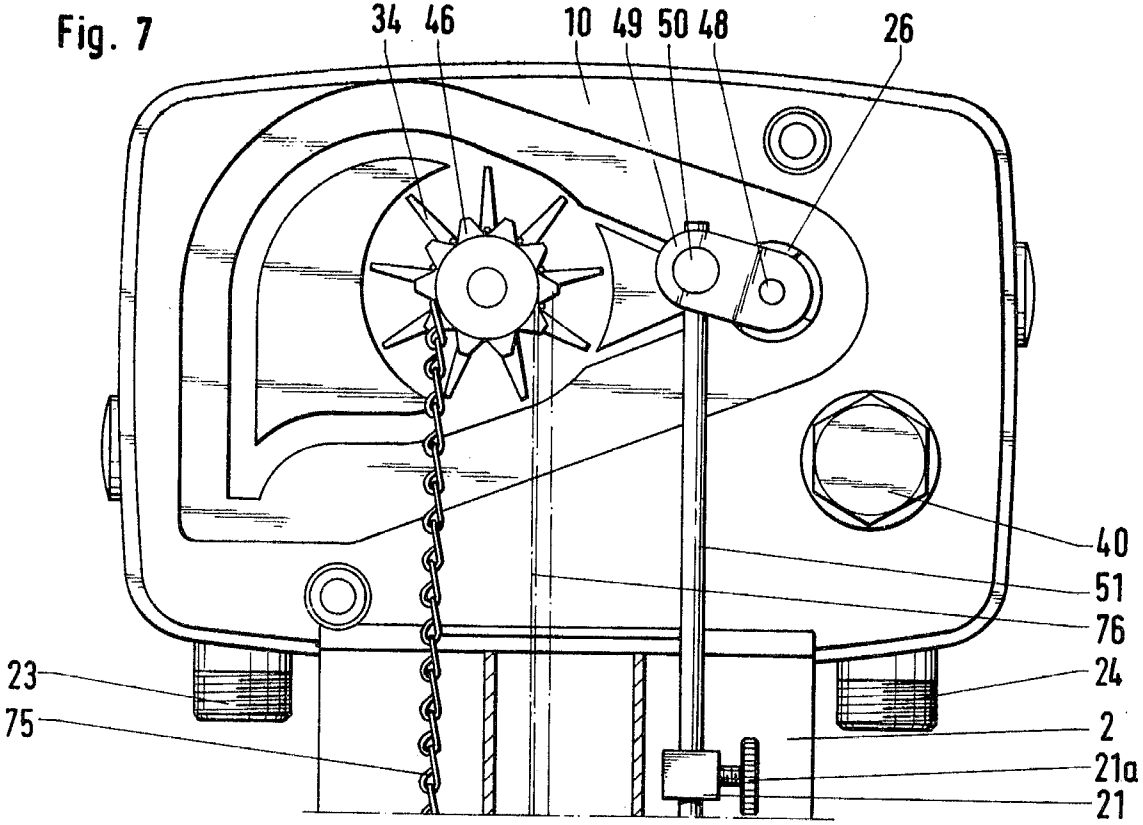
Figure 8:
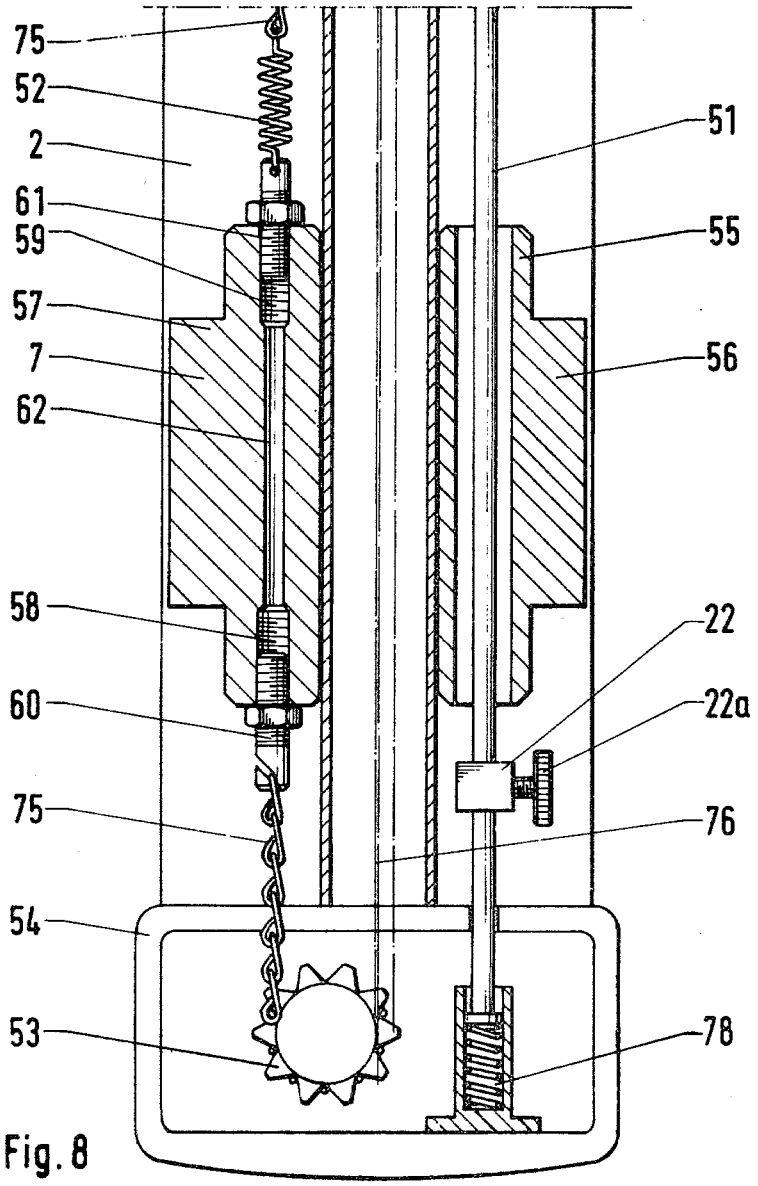
Figure 9:
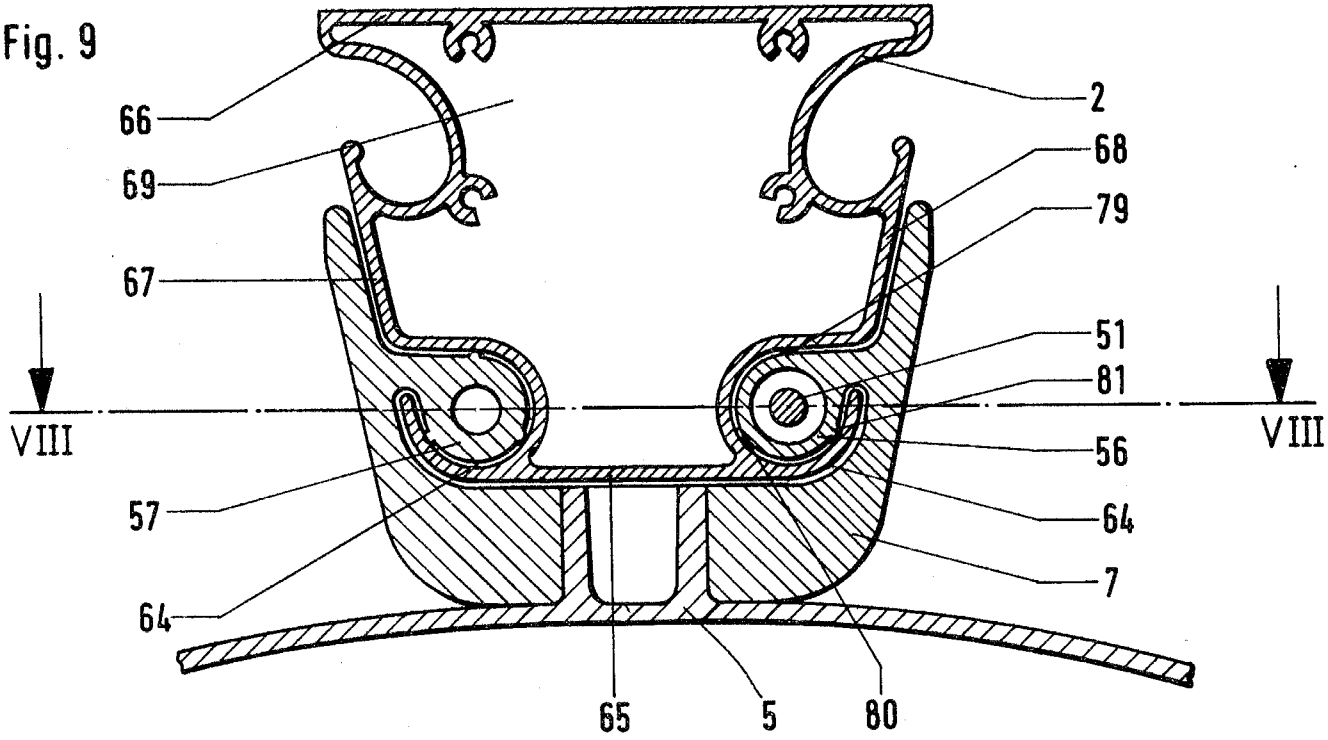

FIG. 6*a* is a cross-sectional view of FIG. 5 taken along the line VI*a*—VI*a* in direction of the arrows;

FIG. 7 is another view similar to that of FIG. 5 with the housing cover removed and showing part of the turbine drive mechanism;

FIG. 8 is a vertical sectional view of the lower part of the turbine drive mechanism of which the upper part was shown in FIG. 7, and FIG. 9 is a much-enlarged horizontal cross-sectional view of FIG. 2 taken the guide rail and the slide and traverse disposed thereon.

Figure 1:
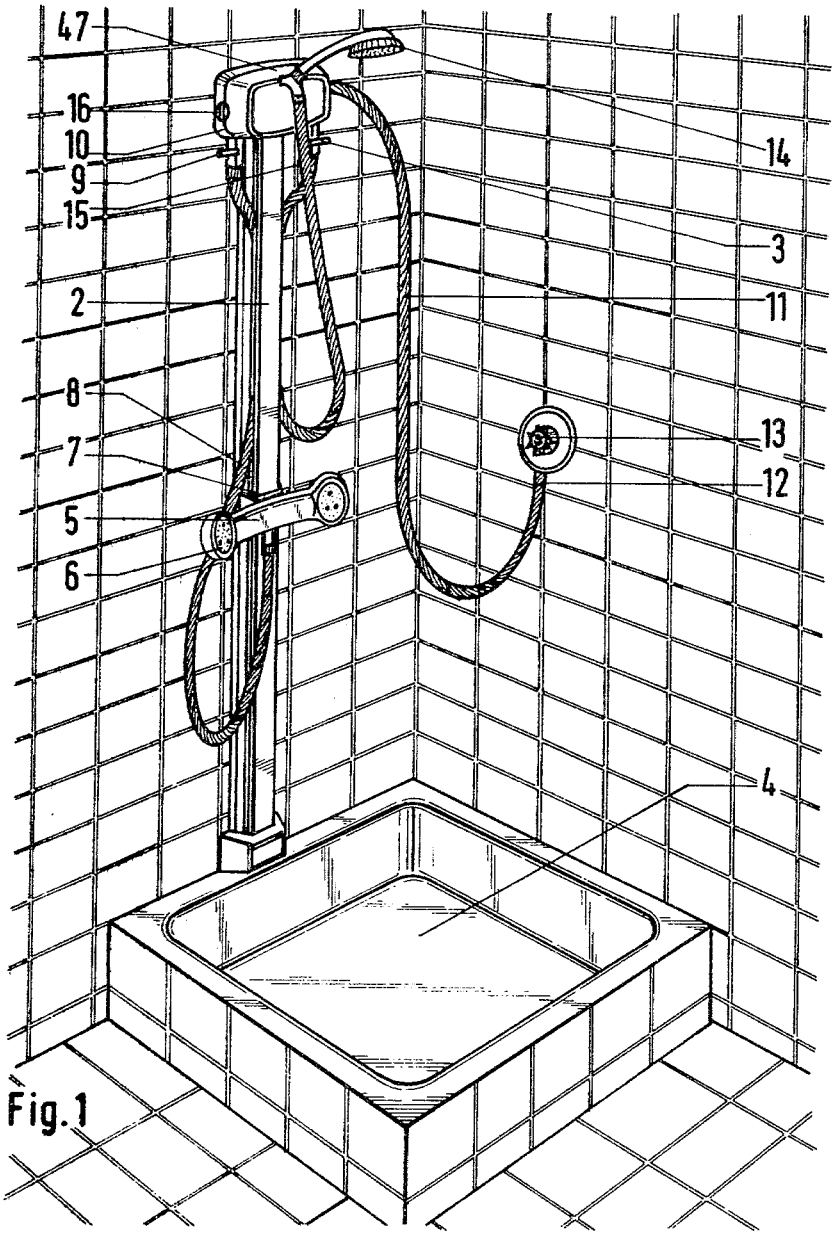
FIG. 1 is a full perspective view of a massage shower with straight vertical guide rails in a shower room.

Referring now to the drawing and first, particularly, to FIG. 1 thereof, there is shown a massage shower according to the invention having a straight vertical guide rail 2 above a shower tub 4 located in a corner of a room. As an example, a traverse 5 is shown, which is constructed so as to be manipulatable by the user, and which has two massage heads 6. The traverse 5 is located on a slide 7 guided on the guide rail 2, the traverse 5 being removable from the slide 7 and turnable relative thereto, i.e. it is adjustable, for example, from the horizontal position thereof illustrated in FIG. 1 to a vertical position so that both massage heads 6 will be disposed above one another in a plane parallel to the guide rail 2. A guide-head water hose 8 is connected to the traverse 5. The water hose 8 is connected through a check valve 9 to a structural unit 10. A connecting water hose 11 extends from the structural unit 10 to a shower water connection 12 on the building side, which has a multifunction operating or control member 13 for adjusting the quantity and temperature of the water.

A shower or spray head 14 is further provided, which is connected through a flexible water hose 15 to the structural unit 10. Directly beneath the latter and upstream of the water hose 8, in travel direction of the water, a check valve 3 is provided so as to be able to use the shower head 14 or shut it off. A check valve 9 serves the same purpose with respect to the two massage heads 6.

Figure 4:
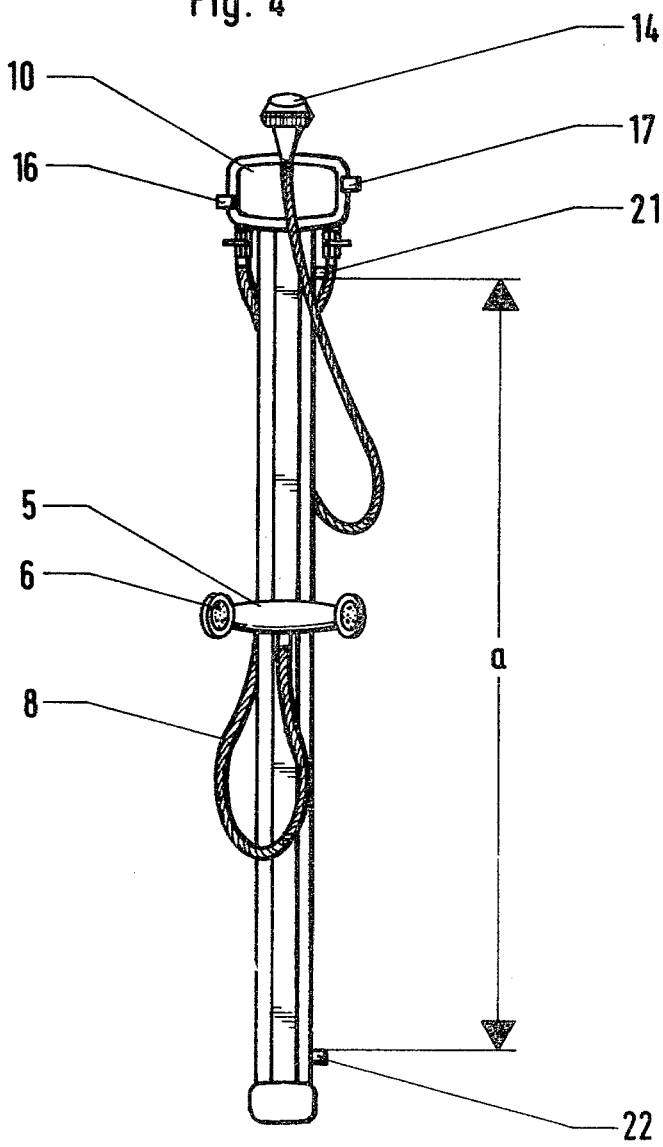
FIG. 4 is a front elevational view of the massage shower of FIG. 1 shown detached from the wall of the shower room.

Three water supply connections or unions, namely, as viewed in FIG. 4, a left-hand union 16 and a right-hand union 17 and, as viewed in FIG. 6*a*, a rear union 18 are located at the structural unit 10. Depending upon the position of the shower water connection or union 12 on the building side, the water hose 11 can be connected to the structural unit 10 selectively from the right-hand, from the left-hand or from the rear side, as viewed in FIG. 1, for example, both of the unused connections or unions being suitably closed.

FIG. 2 shows the massage shower during operation thereof. The guide rail 2 is sufficiently long so that the spray or shower head 14, which can, for example, simply be suspended from the structural unit 10, can be located at a sufficient height above the head even for very tall showering persons 20, and the displacement of the slide 7 can be adjusted so as to permit massaging of all parts of the body.

Figure 3:
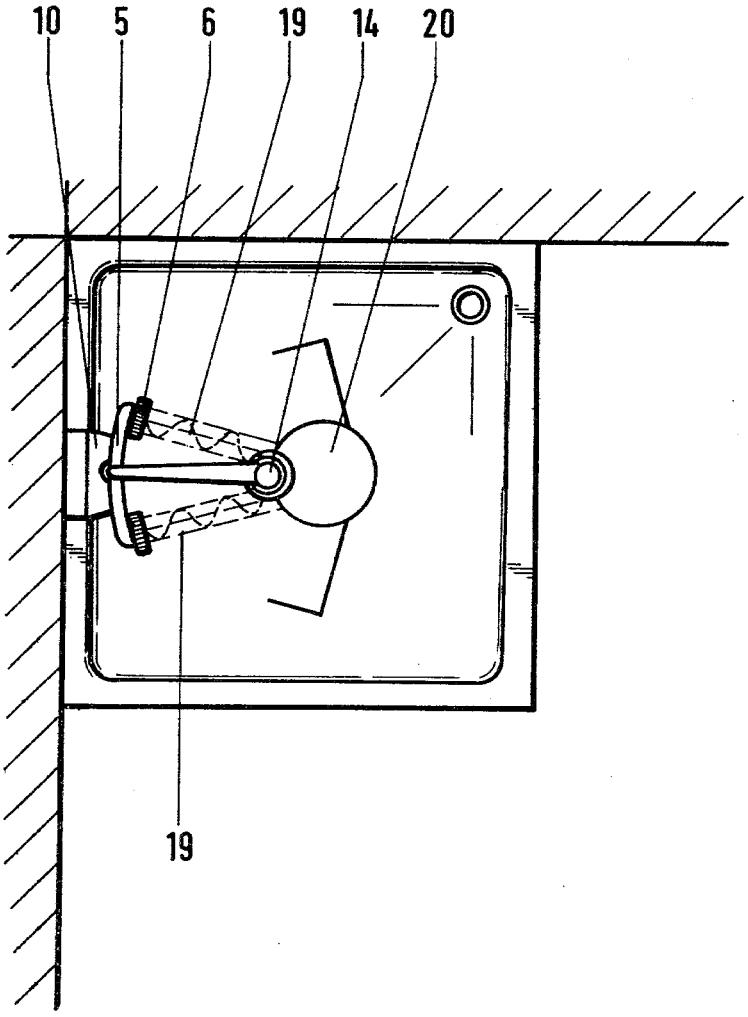
FIG. 3 is a top plan view of FIG. 1.

FIG. 3 is a view from above of the orientation or adjustment of both water jets 19 on a person 20. It is apparent that, because of the provision of two massage heads 6, a wider body region can be massaged so that, in connection with the reciprocating displacement of the slide 7, a large-area massaging action is produced.

FIG. 4 clearly shows that the massage shower is constructed as a complete structural member ready for connection. Stops 21 and 22 limit the displacement of the traverse 5 carrying the massage head 6 and can be adjusted to a given spacing a from one another. They are fastened to a change-over rod 51 (FIGS. 7 and 8).

The structural unit 10 is shown in FIG. 5 diagrammatically with the outer connections or unions and the essential inner elements thereof; all of the parts located forward of the turbine 32 i.e. especially a sprocket wheel 46, a chain 75 and the change-over rod 51, as shown in FIG. 7, have been omitted so that the various water-conducting channels and bores are recognizable all the better. The left-hand and right-hand water supply connections or unions, 16 and 17 are indicated. A connecting nozzle 23 is provided at the left-hand side at the bottom of the structural unit 10, as viewed in FIG. 5, for example, on the structural unit 10 for the water hose 8 leading to the massage head 6 (according to the connection shown in FIGS. 1, 2 and 4). A water hose 15 leading to the spray head 14 is connectible to a connecting nozzle 24 located at the right-hand side at the bottom of the structural unit 10 as viewed in FIG. 5. Directly below the connecting nozzles 23 and 24, the check valves 9 and 3, respectively, are located.

The three water supply connections or unions 16,17 and 18 are connected by a system of channels and bores, to one another as described in detail hereinafter with respect to FIG. 5*a*, as well as to the two connecting nozzles 23 and 24 and a slide valve 26.

A short longitudinal channel 77 extends toward the left-hand side, as viewed in FIG. 5*a* directly to the slide valve 26 from the water supply connection or union 17 at the right-hand side of the structural unit 10. A longer longitudinal channel 25 extends toward the right-hand side, from the water supply connection or union 16 on the left-hand side of the structural unit 10, as viewed in FIG. 5*a*, up to a connecting bore 39 which extends toward the rear to the short longitudinal channel 17 and toward the front to the connecting nozzle 24. The water supply connections or unions 16 and 17, the connecting nozzles 24, as well as the slide valve 26 are connected to one another through the channels 25 and 77 and the bore 39.

The channels 25 and 77 as well as the bore 39 are disposed in the plane of the drawing of FIG. 5*a*. In a cross-sectional view thereof taken along the line VI*a*—VI*a*, as shown in FIG. 6*a*, a transverse bore 41 extending to the rear water supply connection or union 18 is illustrated which terminates thereat in the channel system 25/39/77 where the longer longitudinal channel 25 meets the connecting bore 39. Any other location of the channel system 25/39/77 would be less suited for the termination of the transverse bore 41 due to flow-engineering and constructional causes.

The transverse bore 41 passes through the entire structural unit 10 so as to be able to operate or actuate the plug of the rear water supply connection or union 18 by means of a slender screw 40 (which does not fill out the transverse bore 41 but rather defines, with the wall of the transverse bore 41, a cylindrical channel).

According to FIG. 5*a*, the shorter longitudinal channel 77 extends from the water supply connection or union 17 to the control or slide valve 26, which is constructed as a rotary slide valve and has a funnel-shaped inlet opening, as shown in FIG. 5, as well as two branching outlet lines 28 and 29.

Two feed lines 30 and 31 are provided in the structural unit 10 which extend from the control or slide valve 26 to the turbine 32. The latter has a turbine housing 33 integral with the structural unit 10 and a turbine wheel 34.

In the illustrated position of the slide valve 26 in FIG. 5, the upper outlet line 28 is connected with the upper feed line 30.

The turbine wheel 34 rotates in direction of the associated curved arrow and drives the sliding carriage 7 in one travel direction, for example, downwards, by means of the drive mechanism illustrated in FIGS. 7 and 8. After the water flows through the turbine 32, it passes through the lower outflow channel 36 to the connecting nozzle 23 and further to the massage heads 6.

FIG. 6 shows that the turbine wheel 34 is post-connected to a reduction gearing 44, on a shaft 45 of which located on the driven side, a sprocket wheel 46 is fastened; instead of the illustrated sprocket-wheel drive, a V-belt or toothed belt drive can be used advantageously if quieter running or operation is desired. The reduction gearing 44 is fully located in the structural unit 10 which is covered at the front thereof by a hood or cap 47 (indicated in phantom in FIG. 6 and in solid lines in FIGS. 1 and 2). The sprocket wheel 46 drives a chain 75 which, in turn, drives the slide carriage 7.

The control or slide valve 26 is seated on a control shaft 48 which is firmly connected to a clamp 49. The latter surrounds a transverse guide rod or control lever 50 which, for its part, is firmly connected with the change-over rod 51 extending axially parallel to the guide rail 2. The transverse control lever 50 can rotate in the clamp 49.

FIG. 8 shows the lower part of the drive mechanism in vertical sectional view taken along the section line VIII—VIII in FIG. 9 passing through two guide members 56 and 57 which form the parts of the slide carriage 7 shown in FIG. 8. The chain 75, with biasing action through a spring 52, engages the top of the guide member 57 of the slide carriage 7 shown at the left-hand side of FIG. 8. The other end of the chain 75 extends over a deflecting or reversing wheel 53 to the underside of the guide member 57 of the slide carriage 7 shown at the left-hand side of FIG. 8. The stringer 76 of the chain forming the length thereof shown at the right-hand side of the sprocket wheel 53 in FIG. 8 and guided through a hollow chamber 69 (FIG. 9) formed in the guide rail 2 is represented only in phantom in FIG. 8. The deflecting or reversing wheel 53 is located in a lower housing part 54 into which the change-over rod 51 also extends. The changeover rod 51 passes through a through-bore 55 formed in the hollow guide member 56 of the slide carriage 7 shown at the right-hand side of FIG. 8. A compression-spring assembly 78 braces the change-over rod 51 in a manner that the weight thereof is balanced or neutralized.

The chain 75 grips the guide member 57 shown at the left-hand side of FIG. 8. This guide member is formed with threaded bores 58 and 59 at the top and bottom thereof for inserting therein tension or tie belts 60 and 61 for the chain 75.

FIG. 9 shows the guide rail 2 in horizontal section; it is constructed with a hollow-chamber profile or outline and has, on both sides of the chamber 69 thereof, two slide guides 64 circular in cross-section to the guidance direction, as well as lateral surfaces 67 and 68 extending at an obtuse angle to the side 66 by which the guide rail 2 is connected to the wall of the shower room. The slide carriage 7 spans the guide rail 2 and extends over the lateral surfaces 67 and 68 so as to cover the laterally open slide guides 64 and prevent penetration by foreign material such as soap foam, for example. The guide members 56 and 57 of the slide carriage 7 engage in the slide guides 64. The guide members 56 and 57 carry longitudinal ribs 79, 80 and 81 extending in direction of guidance (perpendicularly to the plane of the drawing of FIG. 9). Only by these ribs 79,80 and 81, do the guide members 56 and 57 make contact with the slide guides 64. The sliding friction is decreased by the reduction in area of the friction surfaces. The ribs 79,80 and 81 are distributed at equal angles to one another about the periphery of the guide members 56 and 57.

The change-over rod 51 carries a respective upper stop 21 (FIGS. 4 and 7) near the upper end thereof, and a lower stop 22 (FIGS. 4 and 8) near the lower end thereof. Each of the stops 21 or 22 is fixable or releasable by means of a screw 21*a* and 22*a*, respectively, on the change-over rod 51 for adjusting the spacing or distance a (FIG. 4).

In downward movement, the slide carriage 7 slides the lower stop 22 downwardly. The change-over rod 51 is entrained thereby and tips over the slide valve 26 by means of transverse control lever 50 and the clamp 49 so that the rotary direction of the turbine wheel 34 and, thus, of the entire drive is reversed. A consequence thereof is that the slide carriage 7 is displaced upwardly until it slides upwardly to the upper stop 21. The change-over rod 51 is entrained thereby and again tips over the slide valve 26 by means of the transverse control lever 50 and the clamp 49 so that the drive is again reversed. This change in drive direction is repeated without end.

The manner of operation of the massage shower according to the invention is believed to be readily apparent from the foregoing explanations. The turbine wheel 34 tends to rotate at a main's water pressure of 1.5 bar with a no-load rotary speed of 1100 r.p.m., and at a conventional main's water pressure of 3 to 3.5 bar with a rotary speed of about 3000 r.p.m. By means of the reduction gearing 44 and the chain drive, an adequate force is produced for lifting the slide carriage 7 with traverse 5 having a total weight of, for example, 5 Kg. The instant the slide carriage 7 reaches the upper stop 21, the change-over rod 51 is raised and adjusts the slide valve 26. In the downward movement, the slide carriage 7 then reaches the lower stop 22, moves the change-over rod 51 and, accordingly, the slide valve 26, into the original position thereof and thereby reintroduces the upward movement.

The transfer of the rotary movement of the reduction gearing 44 into a longitudinal movement of the slide carriage 7 can occur, in a modified embodiment of the invention, by means of a belt drive or a threaded spindle. Furthermore, the turbine can be disposed in the slide carriage 7 per se so that the slide carriage 7 can be displaced on any desired guide path. In this case, care must be taken, for a rectilinear displacement, only that the massage-head water hose 8 be of adequate length, and for a displacement over a closed guide path, that the hose length be adequate and that a rotation coupling be provided at the water hose 8 so that the latter does not become twisted.

There are claimed:

1. Massage shower with a substantially vertical guide rail comprising a massage head for delivering service water, said massage head being automatically displaceable upwardly and downwardly along the guide rail and fixable in a selective position thereon, and means driven and controlled by the service water for driving the massage head in longitudinal direction of the guide rail, said means for driving the massage head in longitudinal direction of the guide rail being constructed as a reversing drive comprising a turbine housing, a turbine wheel mounted for rotation in said turbine housing and means, including a slide valve, for selectively supplying service water in two tangential directions corresponding to opposite rotary directions of the turbine wheel.

2. Massage shower according to claim 1 including a reduction gearing connected to said turbine on a driven side thereof.

3. Massage shower according to claim 2 including a chain wheel and a chain disposed at said reduction gearing on said driven side, and a slide carriage slidably mounted on the guide rail, said chain being connected at one end thereof to an upper side of said slide carriage and at the other end around a deflecting roller to an underside of said slide carriage.

4. Massage shower according to claim 3 including a displaceable change-over rod disposed axially parallel to the guide rail, respective stop members adjustably carried by said change-over rod above and below said slide carriage, said change-over rod being in engagement with said slide valve.

5. Massage shower according to claim 1 wherein the guide rail is constructed as a hollow-chamber section formed with two laterally open slide guides and two lateral surfaces extending at an obtuse angle toward a side thereof by which the guide rail is connectible to a shower-room wall, and including a slide carriage spanning the guide rail inclusive of the lateral surfaces, covering said laterally open slide guides, and formed with guide members guidingly engaging in said slide guides.

6. Massage shower according to claim 5 wherein at least one of said slide guides, on the one hand, and said guide members, on the other hand, is formed with at least three guide ribs extending parallel to the guide rail and forming common contact locations therebetween.

7. Massage shower according to claim 5 wherein one of said guide members is of hollow construction, and including a displaceable change-over rod disposed axially parallel to the guide rail, said change-over rod being loosely surrounded by said one hollow guide member.

8. Massage shower according to claim 3 including a slide carriage wherein said turbine and said slide valve are located, gear means located at said reduction gearing on the driven side thereof, a toothed rack in the guide rail being in meshing engagement with said gear means, means for supplying water to the massage head, said water supplying means comprising a service water supply connection and a flexible water hose having a length greater than the greatest distance of said slide carriage from said service water supply connection, said flexible water hose connection, said massage head to said service water supply connection.

9. Massage shower according to claim 2 wherein the guide rail is in the form of a closed curve.

* * * * *